US010927857B2

(12) United States Patent
Takakuwa et al.

(10) Patent No.: US 10,927,857 B2
(45) Date of Patent: Feb. 23, 2021

(54) DRIVING METHOD AND DRIVING DEVICE OF FLUID PRESSURE CYLINDER

(71) Applicant: SMC CORPORATION, Chiyoda-ku (JP)

(72) Inventors: Youji Takakuwa, Kitakatsushika-gun (JP); Hiroyuki Asahara, Tsukuba (JP); Kengo Monden, Ushiku (JP); Aki Iwamoto, Kasukabe (JP); Naoki Shinjo, Nagareyama (JP); Kazutaka Someya, Kashiwa (JP); Akihiro Kazama, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/335,046

(22) PCT Filed: Sep. 4, 2017

(86) PCT No.: PCT/JP2017/031793
§ 371 (c)(1),
(2) Date: Mar. 20, 2019

(87) PCT Pub. No.: WO2018/056036
PCT Pub. Date: Mar. 29, 2018

(65) Prior Publication Data

US 2019/0277310 A1 Sep. 12, 2019

(30) Foreign Application Priority Data

Sep. 21, 2016 (JP) ..... JP2016-184211
Dec. 27, 2016 (JP) ..... JP2016-253074

(51) Int. Cl.
*F15B 11/02* (2006.01)
*F15B 11/024* (2006.01)
(Continued)

(52) U.S. Cl.
CPC ..... *F15B 11/024* (2013.01); *F15B 1/027* (2013.01); *F15B 21/14* (2013.01);
(Continued)

(58) Field of Classification Search
CPC ..... F15B 11/024; F15B 2211/75; F15B 11/02; F15B 2211/3058; F15B 2211/775; F15B 2211/3133; F15B 2211/46
See application file for complete search history.

(56) References Cited

U.S. PATENT DOCUMENTS 9,175,698 B2 * 11/2015 Oguma ..... E02F 9/22
2013/0167522 A1 7/2013 Oguma et al.

FOREIGN PATENT DOCUMENTS

CN 202152773 U 2/2012
CN 103225632 A 7/2013
(Continued)

OTHER PUBLICATIONS

International Search Report and Written Opinion dated Dec. 20, 2017, in PCT/JP2017/031793 filed on Sep. 4, 2017.
(Continued)

*Primary Examiner* — Abiy Teka
(74) *Attorney, Agent, or Firm* — Oblon, McClelland, Maier & Neustadt, L.L.P.

(57) ABSTRACT

A fluid pressure cylinder driving device includes a switch valve, a high pressure air supply source, an exhaust port and a check valve. When the switch valve is at a first position, a head side cylinder chamber communicates with the high pressure air supply source, and a rod side cylinder chamber communicates with the exhaust port. When the switch valve is at a second position, the head side cylinder chamber communicates with the rod side cylinder chamber via the check valve, and the head side cylinder chamber communicates with the exhaust port.

14 Claims, 11 Drawing Sheets

(51) Int. Cl.
*F15B 1/027* (2006.01)
*F15B 21/14* (2006.01)

(52) U.S. Cl.
CPC . *F15B 2211/212* (2013.01); *F15B 2211/3133* (2013.01); *F15B 2211/31576* (2013.01); *F15B 2211/31582* (2013.01); *F15B 2211/40515* (2013.01); *F15B 2211/41554* (2013.01); *F15B 2211/7053* (2013.01); *F15B 2211/75* (2013.01)

(56) References Cited

FOREIGN PATENT DOCUMENTS

| | | | | |
|---|---|---|---|---|
| DE | 1 601 740 | A1 | 1/1971 | |
| DE | 1601740 | A1 * | 1/1971 | ..... F15B 11/024 |
| EP | 2 610 503 | A2 | 7/2013 | |
| FR | 2 524 580 | A1 | 10/1983 | |
| JP | 58-118303 | A | 7/1983 | |
| JP | 2-2965 | Y2 | 1/1990 | |
| JP | 2009-275770 | A | 11/2009 | |
| JP | 2013-137062 | A | 7/2013 | |
| JP | 2018-54118 | A | 4/2018 | |
| WO | WO 2018/056037 | A1 | 3/2018 | |

OTHER PUBLICATIONS

Office Action dated Nov. 12, 2019 in Japanese Patent Application No. 2016-253074 (with unedited computer generated English translation), 8 pages.
Combined Chinese Office Action and Search Report dated Dec. 16, 2019 in Chinese Patent Application No. 201780058230.5 (with English translation), 16 pages.
Korean Office Action dated Apr. 29, 2020 in Patent Application No. 10-2019-7011488 (with English translation), 13 pages.

* cited by examiner

20

20

DRIVING METHOD AND DRIVING DEVICE OF FLUID PRESSURE CYLINDER

TECHNICAL FIELD

The present invention relates to a driving method and a driving device of a fluid pressure cylinder. More particularly, the present invention relates to the driving method and the driving device of a double acting fluid pressure cylinder that do not need a large driving force in a return process.

BACKGROUND ART

Conventionally, a driving device of a double acting actuator driven by air pressure is known which needs a larger output in a driving process and does not need a larger output in a return process (see Japanese Utility Model Publication No. 2-002965).

As shown in FIG. 11, this actuator driving device recovers and accumulates, in an accumulator 12, part of exhaust air discharged from a drive side pressure chamber 3 of a double acting cylinder device 1, and uses the part of exhaust air as return power of the double acting cylinder device 1. More specifically, when a switch valve 5 is switched to a state depicted in FIG. 11, a high pressure exhaust air in a drive side pressure chamber 3 is accumulated in the accumulator 12 through a recovery port 10*b* of a recovery valve 10. When an exhaust air pressure lowers and a difference between the exhaust air pressure and an accumulator pressure becomes small, remaining air in the drive side pressure chamber 3 is discharged from a exhaust port 10*c* of the recovery valve 10 to the atmosphere, and accumulated pressure air of the accumulator 12 simultaneously flows in a return side pressure chamber 4.

SUMMARY OF INVENTION

The actuator driving device has a problem that, even when the switch valve 5 is switched, until the difference between the discharge air pressure and the accumulator pressure becomes small, the high pressure air in the drive side pressure chamber 3 is not discharged to the atmosphere, and therefore it takes time to obtain a thrust necessary for the double acting cylinder device 1 to return. The recovery valve 10 has to take a complex structure that connects an inlet port 10*a* of the recovery valve 10 with the recovery port 10*b* while a pressure difference between the exhaust air pressure and the accumulator pressure is large, and connects the inlet port 10*a* with the exhaust port 10*c* when the pressure difference between the exhaust air pressure and the accumulator pressure is small.

The present invention has been made by taking such a problem into account. An object of the present invention is to save energy by returning a fluid pressure cylinder reusing a discharge pressure, and reduce a necessary return time as much as possible. Another object of the present invention is to simplify a circuit that returns the fluid pressure cylinder by reusing a discharge pressure.

A method for driving a fluid pressure cylinder according to the present invention includes a driving step and a return step. The driving step includes supplying a fluid from a fluid supply source to one cylinder chamber, and discharging the fluid from another cylinder chamber to at least an outside. The return step includes supplying part of the fluid accumulated in the one cylinder chamber toward the other cylinder chamber, and discharging the other part of the fluid accumulated in the one cylinder chamber to at least the outside.

A driving device of a fluid pressure cylinder according to the present invention is a driving device of a double acting fluid pressure cylinder that includes: a switch valve; a fluid supply source; a discharge port; and a supply check valve. In this case, when the switch valve is at a first position, one cylinder chamber communicates with the fluid supply source, and another cylinder chamber communicates with at least the discharge port. When the switch valve is at a second position, the one cylinder chamber communicates with the other cylinder chamber via the supply check valve, and the one cylinder chamber communicates with at least the discharge port.

The driving method and the driving device of the fluid pressure cylinder supply fluid accumulated in the one cylinder chamber to the other cylinder chamber and at the same time, discharge the fluid to the outside. Consequently, the fluid pressure of the other cylinder chamber increases and the fluid pressure of the one cylinder chamber rapidly decreases. Consequently, it is possible to shorten a time necessary for returning the fluid pressure cylinder as much as possible. Further, the recovery valve having a complicated structure is not necessary, and only a simple circuit configuration such as the supply check valve needs to be employed. Consequently, it is possible to simplify a circuit that returns the fluid pressure cylinder.

In the driving device of the fluid pressure cylinder, a first throttle valve is preferably arranged between the switch valve and the discharge port. Consequently, it is possible to limit the amount of the fluid discharged to the outside and sufficiently save energy.

The first throttle valve is preferably a variable throttle valve. Consequently, it is possible to adjust a ratio of the amount of the fluid accumulated in the one cylinder chamber and supplied to the other cylinder chamber, to the amount of the fluid accumulated in the one cylinder chamber and discharged to the outside.

In the driving device of the fluid pressure cylinder, a first tank is preferably arranged between the other cylinder chamber and the switch valve. Consequently, it is possible to accumulate the fluid discharged from the one cylinder chamber in the first tank connected to the other cylinder chamber, and prevent as much as possible the pressure of the fluid from lowering when the volume of the other cylinder chamber increases during the return step.

Preferably, a volume of the first tank is substantially half a maximum value of a fluctuating volume of the one cylinder chamber. Consequently, it is possible to achieve a proper balance between a function of quickly increasing the fluid pressure of the other cylinder chamber when the fluid accumulated in the one cylinder chamber is supplied to the other cylinder chamber, and a function of preventing the pressure of the fluid from lowering when the volume of the other cylinder chamber increases.

In the driving device, instead of the configuration including the first tank, a volume of a tube reaching from the supply check valve to the other cylinder chamber across the switch valve may be larger than a volume of other tubes of the driving device. Consequently, it is possible to sufficiently secure the volume in the tube extending from the supply check valve to the inlet of the other cylinder chamber across the switch valve and thus omit the first tank. Even in this case, it is possible to easily obtain the same effect as a case where the first tank is arranged.

The driving device may further include a second tank connected to the discharge port in parallel to the switch valve. In this case, when the switch valve is at the first position, the other cylinder chamber communicates with the discharge port and the second tank via the switch valve. When the switch valve is at the second position, the one cylinder chamber communicates with the other cylinder chamber via the supply check valve and the switch valve, and communicates with the discharge port and the second tank via the switch valve.

Consequently, part of the fluid discharged from the discharge port to the outside is accumulated in the second tank, so that the amount of consumption of the fluid in the driving device is reduced by the amount of the fluid accumulated in the second tank. As a result, it is possible to further save energy by the driving device.

In this case, by arranging a pressure accumulator check valve between the switch valve and the second tank, it is possible to prevent the fluid once accumulated in the second tank from being discharged to the outside via the discharge port.

Preferably, a second throttle valve is arranged between the switch valve and the discharge port, and the second throttle valve and the discharge port are connected to the second tank in parallel with respect to the switch valve. Consequently, similar to a case where the first throttle valve is arranged, it is possible to limit the amount of the fluid discharged to the outside and sufficiently save energy.

In this case, when the second throttle valve is a variable throttle valve, it is possible to easily adjust a ratio of the amount of the fluid discharged from the switch valve and supplied to the second tank to the amount of the fluid discharged to the outside via the discharge port.

Preferably, in the driving device, an injection mechanism configured to inject a fluid is connected to the second tank via a coupler. Consequently, the fluid accumulated in the second tank is supplied to the injection mechanism via the coupler. Consequently, the injection mechanism can inject the fluid, for example, toward an external object.

The driving device further includes a first fluid supply mechanism configured to, when the switch valve is at the second position and when part of the fluid accumulated in the one cylinder chamber is supplied from the one cylinder chamber to the other cylinder chamber via the supply check valve and the switch valve, supply the fluid accumulated in the second tank to the other cylinder chamber. Consequently, when the pressure of the fluid supplied from the one cylinder chamber to the other cylinder chamber lowers, fluid is supplied from the second tank to the other cylinder chamber via the first fluid supply mechanism. As a result, it is possible to reliably and efficiently return the fluid pressure cylinder.

The driving device preferably further includes a second fluid supply mechanism configured to supply the fluid from the fluid supply source to the second tank. Consequently, when the fluid accumulated in the second tank is used, it is possible to prevent the pressure of the fluid from lowering.

The above and other objects, features and advantages of the present invention will become more apparent from the following description when taken in conjunction with the accompanying drawings in which a preferred embodiment of the present invention is shown by way of illustrative example.

DESCRIPTION OF EMBODIMENTS

A preferred embodiment of a driving method of a fluid pressure cylinder according to the present invention will be described below in relation to a fluid pressure cylinder driving device that carries out this driving method and with reference to the accompanying drawings.

1. Configuration of Present Embodiment

Figure 1:
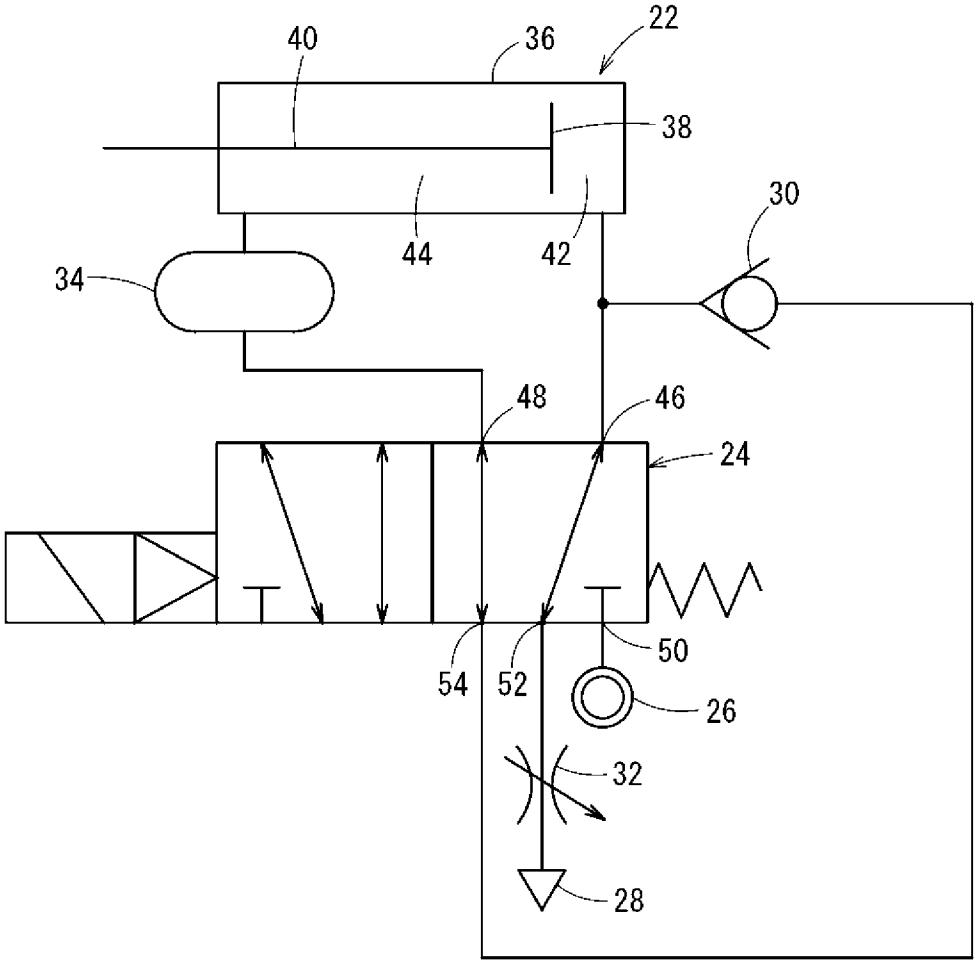
FIG. 1 is a circuit diagram of a fluid pressure cylinder driving device according to an embodiment of the present invention.

As shown in FIG. 1, a fluid pressure cylinder driving device 20 according to an embodiment of the present invention is applied to a double acting air cylinder (fluid pressure cylinder) 22. The fluid pressure cylinder driving device 20 includes a switch valve 24, a high pressure air supply source (fluid supply source) 26, an exhaust port (discharge port) 28, a check valve (supply check valve) 30, a throttle valve (first throttle valve) 32, an air tank (first tank) 34, and predetermined tubes.

The air cylinder 22 includes a piston 38 reciprocally slidably disposed inside a cylinder main body 36. A piston rod 40 includes one end portion that is coupled to the piston 38 and the other end portion that extends from the cylinder main body 36 to the outside. The air cylinder 22 performs work such as the positioning of a workpiece (not shown) when the piston rod 40 is pushed out (extends), and does not perform work when the piston rod 40 retracts. The cylinder main body 36 includes two cylinder chambers partitioned by the piston 38, i.e., a head side cylinder chamber (one cylinder chamber) 42 located at a side opposite to the piston rod 40, and a rod side cylinder chamber (other cylinder chamber) 44 located at the same side as the piston rod 40.

Figure 2:
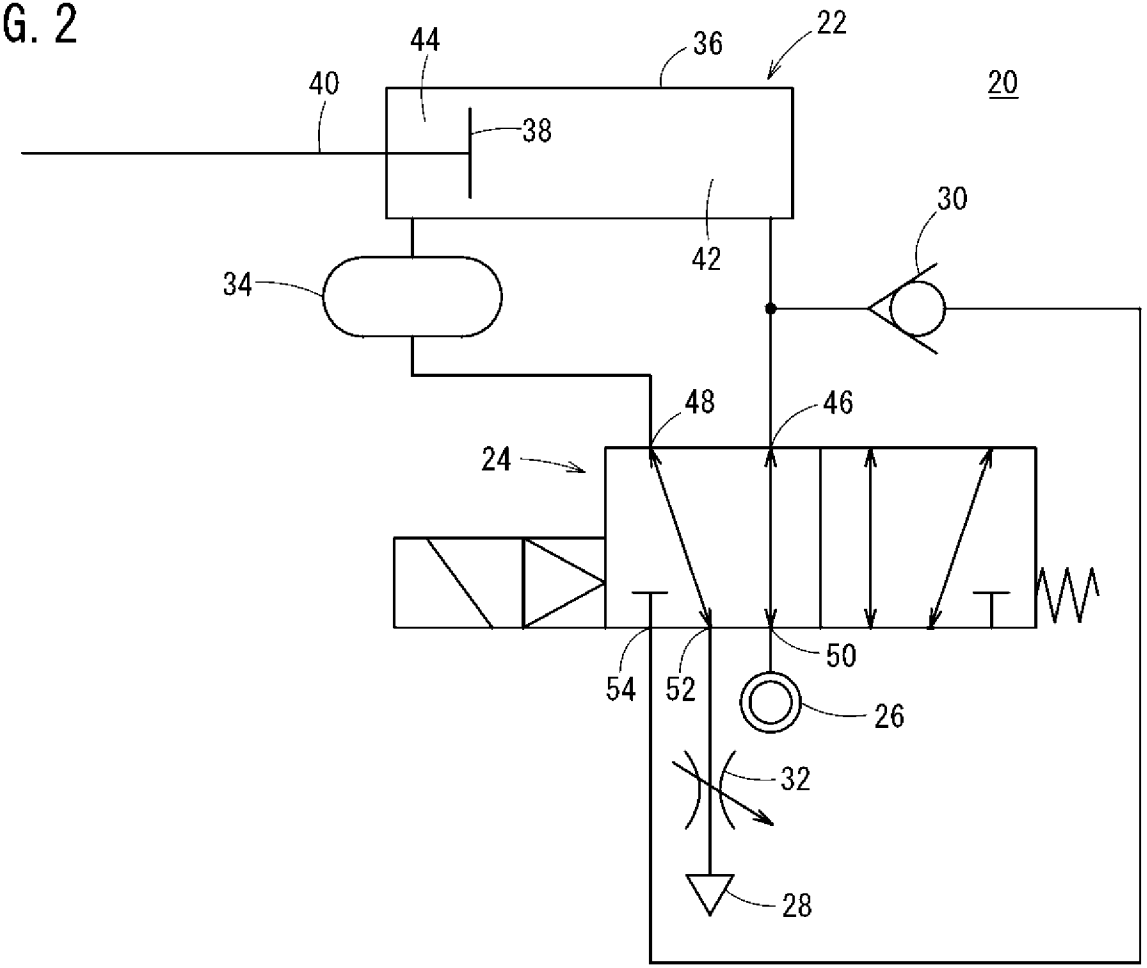
FIG. 2 is a circuit diagram of FIG. 1 in a case where a switch valve is at another position.

The switch valve 24 is configured as a solenoid valve that includes a first port 46 to a fifth port 54 and can be switched between a first position shown in FIG. 2 and a second position shown in FIG. 1. The first port 46 is connected to the head side cylinder chamber 42 through a tube, and is connected to an upstream side of the check valve 30. The second port 48 is connected to the rod side cylinder chamber 44 through a tube via the air tank 34. The third port 50 is connected to the high pressure air supply source 26 through a tube. The fourth port 52 is connected to the exhaust port 28 through a tube via the throttle valve 32. The fifth port 54 is connected to a downstream side of the check valve 30 through a tube.

As shown in FIG. 1, when the switch valve 24 is at the second position, the first port 46 and the fourth port 52 are connected, and the second port 48 and the fifth port 54 are connected. As shown in FIG. 2, when the switch valve 24 is at the first position, the first port 46 and the third port 50 are connected, and the second port 48 and the fourth port 52 are connected. The switch valve 24 is held at the second position by a spring biasing force while electric power is not provided, and is switched from the second position to the first position when electric power is provided. Electric power is provided or not with respect to the switch valve 24 when a PLC (Programmable Logic Controller) (not shown) that is a higher level device outputs a power provision command (power provision) or outputs a power provision stop command (non-power provision) to the switch valve 24.

When the switch valve 24 is at the second position, the check valve 30 allows an air flow from the head side cylinder chamber 42 toward the rod side cylinder chamber 44, and blocks the air flow from the rod side cylinder chamber 44 toward the head side cylinder chamber 42.

The throttle valve 32 is arranged to limit the amount of air discharged from the exhaust port 28 and is configured as a variable throttle valve that can change a path area to adjust the amount of air to be discharged.

The air tank 34 is arranged to accumulate air supplied from the head side cylinder chamber 42 toward the rod side cylinder chamber 44. Having the air tank 34 is equivalent to increasing the volume of the rod side cylinder chamber 44. The volume of the air tank 34 is set, for example, to approximately half the volume of the head side cylinder chamber 42 when the piston rod 40 extends to a maximum position (to approximately half the maximum value of the fluctuating volume of the head side cylinder chamber 42).

2. Operation of Present Embodiment

The fluid pressure cylinder driving device 20 according to the present embodiment is basically configured as described above. A function (operation) of the fluid pressure cylinder driving device 20 (a driving method of the air cylinder 22 according to the present embodiment) will be described below with reference to FIGS. 1 and 2. As shown in FIG. 1, a state where the piston rod 40 retracts most is set to be an initial state.

When electric power is provided to the switch valve 24 and the switch valve 24 is switched from the second position (see FIG. 1) to the first position (see FIG. 2) in this initial state, a driving process is performed. The driving process includes supplying the high pressure from the high pressure air supply source 26 to the head side cylinder chamber 42 and discharging air of the rod side cylinder chamber 44 to the exhaust port 28 via the throttle valve 32. In the driving process, the piston rod 40 extends to the maximum position as shown in FIG. 2, and is held at the maximum position by a large thrust.

When the piston rod 40 extends and does an operation such as the positioning of the workpiece and then the electric power provision to the switch valve 24 is stopped, the switch valve 24 is switched from the first position to the second position, and the return process is performed. In the return process, part of the air accumulated in the head side cylinder chamber 42 is supplied toward the rod side cylinder chamber 44 through the check valve 30. Simultaneously, the other part of the air accumulated in the head side cylinder chamber 42 is discharged from the exhaust port 28 via the throttle valve 32. In this case, the air supplied toward the rod side cylinder chamber 44 is mainly accumulated in the air tank 34. This is because, before the piston rod 40 starts retracting, the air tank 34 occupies the largest volume among the space stretching between the check valve 30 and the rod side cylinder chamber 44 where air can be present, the space including the rod side cylinder chamber 44 and the tubes. Subsequently, when the air pressure of the head side cylinder chamber 42 decreases, the air pressure of the rod side cylinder chamber 44 rises, and when the air pressure of the rod side cylinder chamber 44 becomes larger by a predetermined value than the air pressure of the head side cylinder chamber 42, the piston rod 40 starts retracting. Further, the piston rod 40 returns to the initial state where the piston rod 40 retracts most.

Figure 3:
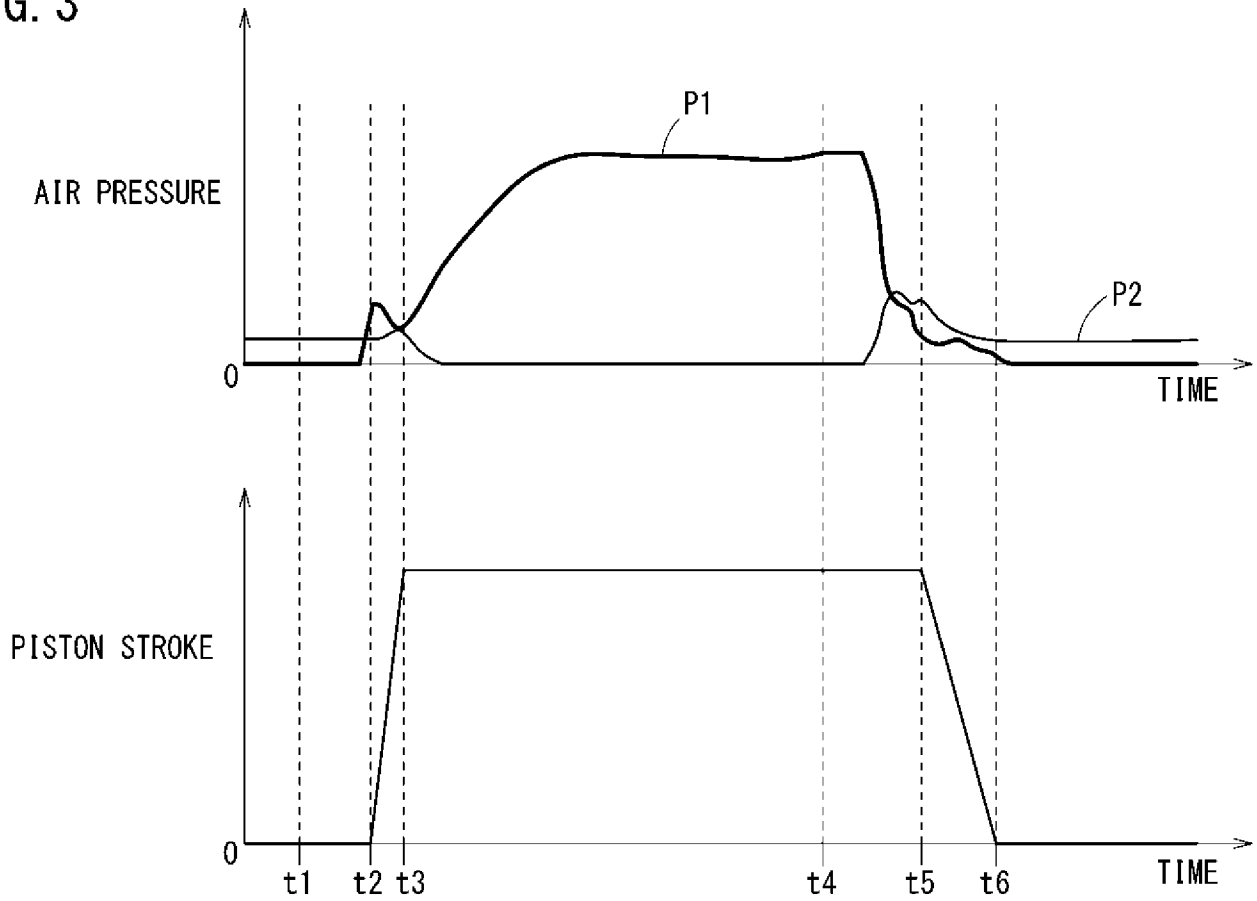
FIG. 3 is a view showing a result obtained by measuring an air pressure of each cylinder chamber and a piston stroke during an operation of the fluid pressure cylinder in FIG. 1.

FIG. 3 shows a result obtained by measuring an air pressure P1 of the head side cylinder chamber 42, an air pressure P2 of the rod side cylinder chamber 44, and a piston stroke in a series of the above operations. An operation principle (the driving process and the return process) of the fluid pressure cylinder driving device 20 will be described below in detail with reference to FIG. 3. In FIG. 3, a zero point of the air pressure indicates that the air pressure is equal to an atmospheric pressure, and a zero point of the piston stroke indicates that the piston rod 40 is at a position at which the piston rod 40 has retracted most.

First, the driving process according to the operation principle of the fluid pressure cylinder driving device 20 will be described. At a time t1 at which the power provision command is outputted to the switch valve 24, the air pressure P1 of the head side cylinder chamber 42 is equal to the atmospheric pressure, and the air pressure P2 of the rod side cylinder chamber 44 is slightly larger than the atmospheric pressure.

When the power distribution command is outputted to the switch valve 24 and then the switch valve 24 is switched from the second position (see FIG. 1) to the first position (see FIG. 2), the air pressure P1 of the head side cylinder chamber 42 starts rising. At a time t2, the air pressure P1 of the head side cylinder chamber 42 exceeds the air pressure P2 of the rod side cylinder chamber 44 by an amount that is more than a static friction resistance of the piston 38, and the piston rod 40 starts moving in a push-out direction (left direction in FIG. 2). Subsequently, at a time t3, the piston rod 40 stretches most. The air pressure P1 of the head side cylinder chamber 42 further rises and then becomes a fixed pressure, and the air pressure P2 of the rod side cylinder chamber 44 lowers and becomes equal to the atmospheric pressure. A temporary decrease in the air pressure P1 of the head side cylinder chamber 42 and a temporary rise in the air pressure P2 of the rod side cylinder chamber 44 between the time t2 and the time t3 are caused by an increase in a volume of the head side cylinder chamber 42 and a decrease in a volume of the rod side cylinder chamber 44.

Next, the return process according to the operation principle of the fluid pressure cylinder driving device 20 will be described. When the power provision stop command is outputted to the switch valve 24 at a time t4, and the switch valve 24 is switched from the first position to the second position, the air pressure P1 of the head side cylinder chamber 42 starts lowering, and the air pressure P2 of the rod side cylinder chamber 44 starts rising. When the air pressure P1 of the head side cylinder chamber 42 becomes equal to the air pressure P2 of the rod side cylinder chamber 44, the check valve 30 functions to stop supply of the air of the head side cylinder chamber 42 to the rod side cylinder chamber 44 whereby the rise of the air pressure P2 of the rod side cylinder chamber 44 halts. Meanwhile, the air pressure P1 of the head side cylinder chamber 42 continues lowering, the air pressure P2 of the rod side cylinder chamber 44 exceeds, at a time t5, the air pressure P1 of the head side cylinder chamber 42 by an amount that is more than the static friction resistance, and the piston rod 40 starts moving in a drawing direction (a right direction in FIG. 1).

As the piston rod 40 moves in the drawing direction, the volume of the rod side cylinder chamber 44 increases. Therefore, the air pressure P2 of the rod side cylinder chamber 44 lowers. However, the air pressure P1 of the head side cylinder chamber 42 lowers at a larger rate. Therefore, the air pressure P2 of the rod side cylinder chamber 44 continues exceeding the air pressure P1 of the head side cylinder chamber 42. A sliding friction of the piston 38 that has once started moving is smaller than a friction resistance of the piston 38. Therefore, the piston rod 40 smoothly moves in the drawing direction. When the piston rod 40 retracts, the air pressure in the air tank 34 is also naturally used as a drawing force (pressing force) with respect to the piston 38.

At a time t6, the piston rod 40 returns to a state where the piston rod 40 retracts most. At this time, the air pressure P1 of the head side cylinder chamber 42 is equal to the atmospheric pressure, and the air pressure P2 of the rod side cylinder chamber 44 is slightly larger than the atmospheric pressure. This state is maintained until a next power provision command is outputted to the switch valve 24.

3. Effect of Present Embodiment

As described above, the driving method of the air cylinder 22 according to the present embodiment and the fluid pressure cylinder driving device 20 supply the air accumulated in the head side cylinder chamber 42 to the rod side cylinder chamber 44 and at the same time discharge the air to the outside. Consequently, the air pressure P2 of the rod side cylinder chamber 44 increases, and the air pressure P1 of the head side cylinder chamber 42 rapidly decreases. Consequently, it is possible to shorten the time necessary for (the piston rod 40 of) the air cylinder 22 to retract as much as possible. The recovery valve of a complicated structure is not necessary, and only a simple circuit configuration such as the check valve 30 needs to be employed. Consequently, it is possible to simplify the circuit that returns the air cylinder 22.

The throttle valve 32 is arranged between the switch valve 24 and the exhaust port 28. Consequently, it is possible to limit the amount of air discharged to the outside, and sufficiently save energy. In this case, the throttle valve 32 is the variable throttle valve. Consequently, the throttle valve 32 can adjust a ratio of the amount of air accumulated in the head side cylinder chamber 42 and supplied to the rod side cylinder chamber 44, to the amount of air accumulated in the head side cylinder chamber 42 and discharged to the outside.

The air tank 34 is arranged between the rod side cylinder chamber 44 and the switch valve 24. Consequently, it is possible to accumulate the air discharged from the head side cylinder chamber 42 in the air tank 34 connected to the rod side cylinder chamber 44, and prevent the air pressure P2 from lowering as much as possible when the volume of the rod side cylinder chamber 44 increases in the return process.

In this case, the volume of the air tank 34 is substantially half the maximum value of the fluctuating volume of the head side cylinder chamber 42. Consequently, when the air accumulated in the head side cylinder chamber 42 is supplied to the rod side cylinder chamber 44, it is possible to achieve a proper balance between the function of quickly increasing the air pressure P2 of the rod side cylinder chamber 44 and a function of preventing the air pressure P2 from lowering when the volume of the rod side cylinder chamber 44 increases.

In the fluid pressure cylinder driving device 20, the throttle valve 32 is arranged to limit the amount of air discharged from the exhaust port 28. However, the throttle valve 32 is not an indispensable component.

Figure 4:
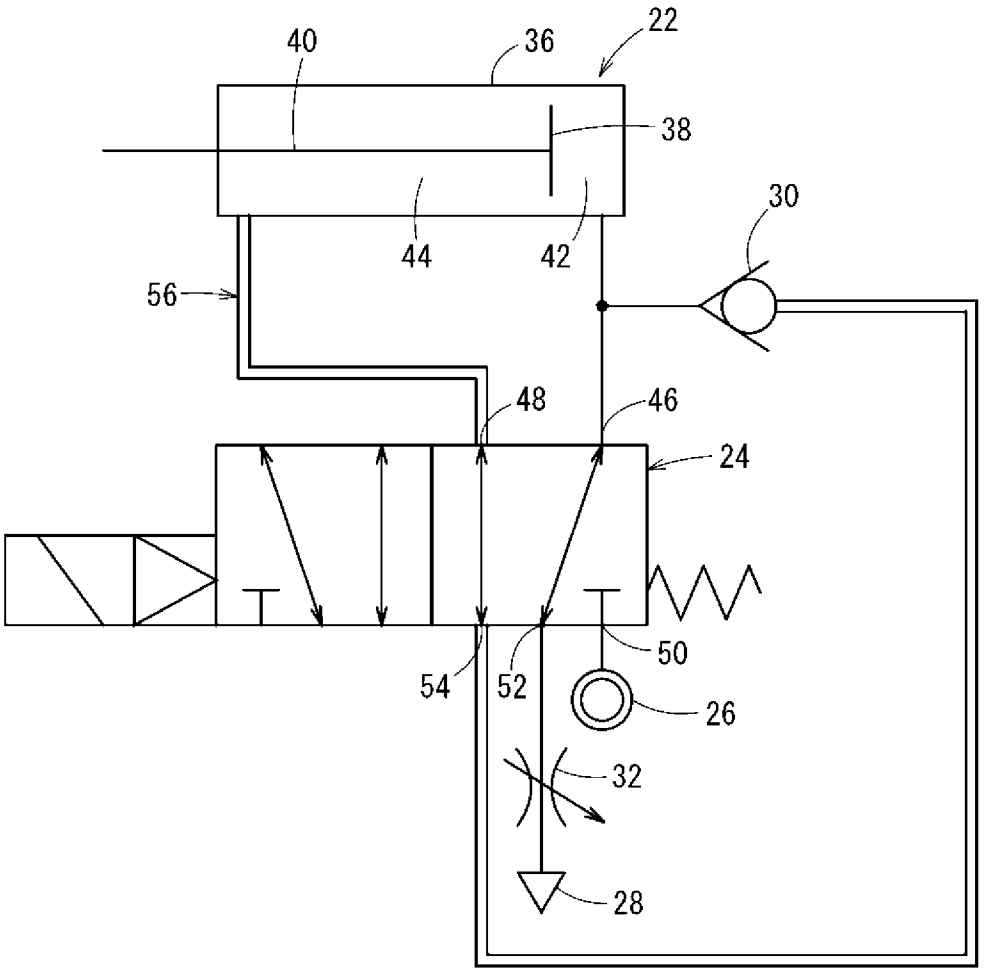
FIG. 4 is a circuit diagram of the fluid pressure cylinder driving device according to another embodiment of the present invention.

The air tank 34 is arranged in the fluid pressure cylinder driving device 20. However, as shown in FIG. 4, the volume of a tube 56 extending from the check valve 30 to the rod side cylinder chamber 44 across the switch valve 24 may be made larger than the volume of other tubes in the fluid pressure cylinder driving device 20. Consequently, it is possible to sufficiently secure the volume in the tube extending from the check valve 30 to an inlet of the rod side cylinder chamber 44 across the switch valve 24, omit the air tank 34, and easily obtain the same effect as a case where the air tank 34 is arranged.

4. Modifications of Present Embodiment

Next, modifications of the fluid pressure cylinder driving device 20 according to the present embodiment (fluid pressure cylinder driving devices 20A to 20F according to first to sixth modifications) will be described with reference to FIGS. 5 to 10. The same components as those in the fluid pressure cylinder driving device 20 according to the present embodiment will be assigned the same reference numerals to describe the first to sixth modifications, and will not be described in detail.

4.1 First Modification

Figure 5:
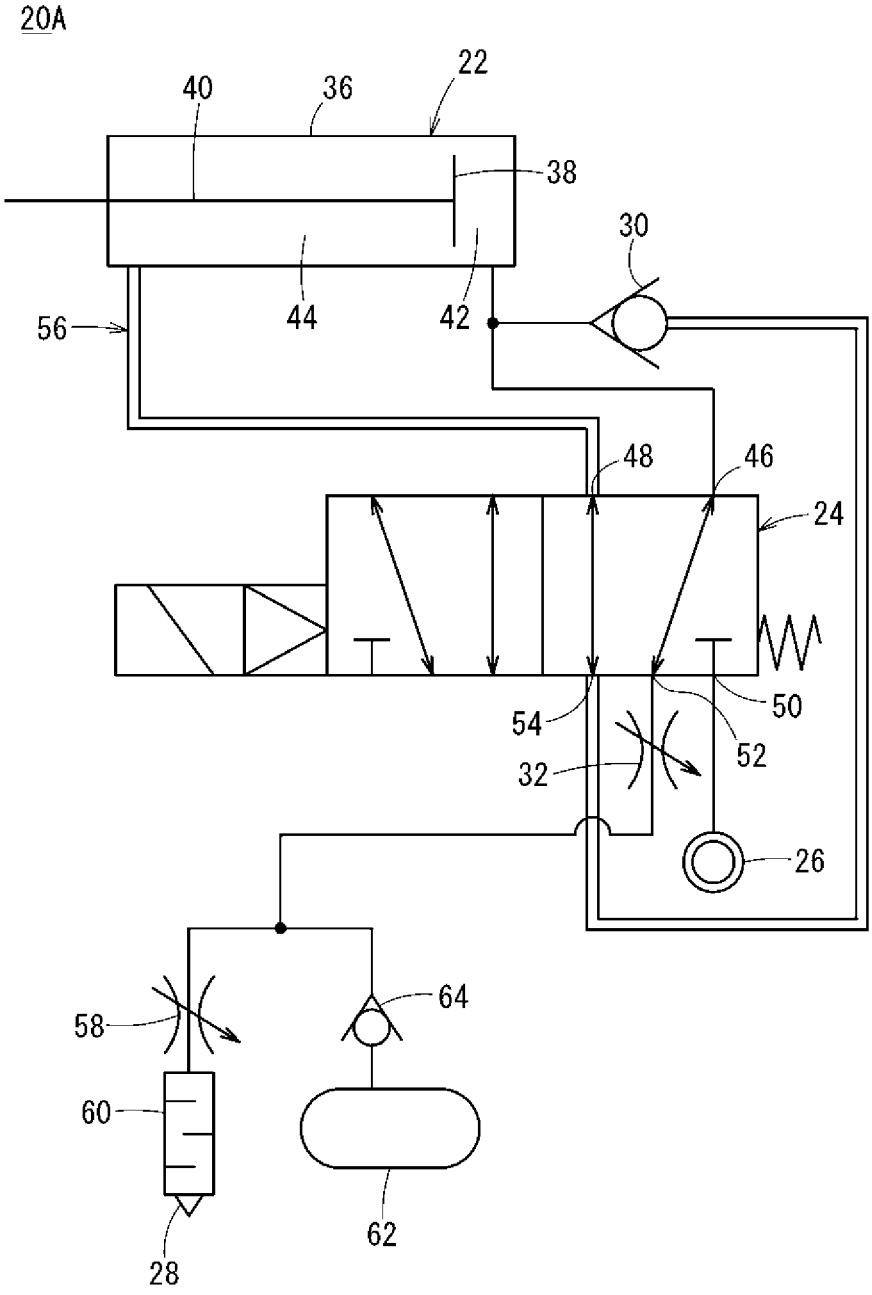
FIG. 5 is a circuit diagram of the fluid pressure cylinder driving device according to a first modification.

The fluid pressure cylinder driving device 20A according to the first modification differs from the configuration of the fluid pressure cylinder driving device 20 shown in FIG. 4 in that, as shown in FIG. 5, a throttle valve (second throttle valve) 58 that is a variable throttle valve, a silencer 60, and the exhaust port 28 are connected to the fourth port 52 in series by tubes via the throttle valve 32.

In this case, the fluid pressure cylinder driving device 20A further includes an air tank (second tank) 62. The air tank 62 is connected to the throttle valve 58, the silencer 60, and the exhaust port 28 in parallel by tubes via a check valve (pressure accumulator check valve) 64. Hence, according to the first modification, the throttle valve 58 and the exhaust port 28, and the air tank 62 are in parallel with respect to the fourth port 52.

In the first modification, when the switch valve 24 is at the second position as shown in FIG. 5, the head side cylinder chamber 42 communicates with the rod side cylinder chamber 44 via the check valve 30, the tube 56, and the switch valve 24, and communicates with the exhaust port 28 and the air tank 62 via the switch valve 24 and the throttle valve 32. When the switch valve 24 is at the first position, the rod side cylinder chamber 44 communicates with the exhaust port 28 and the air tank 62 via the switch valve 24.

Even when the switch valve 24 is at one of the first position and the second position, the fluid pressure cylinder driving device 20A according to the first modification can accumulate part of air discharged from the fourth port 52 to the outside via the exhaust port 28, in the air tank 62 via the check valve 64. Consequently, it is possible to reduce the amount of air consumption in the fluid pressure cylinder driving device 20A by the amount of air accumulated in the air tank 62. As a result, it is possible to further save energy in the fluid pressure cylinder driving device 20A.

The check valve 64 is disposed between the throttle valve 32 and the air tank 62. Consequently, it is possible to prevent air once accumulated in the air tank 62 from reversely flowing and being discharged to the outside via the exhaust port 28.

Furthermore, the throttle valve 58 is arranged and the throttle valve 58, the silencer 60, and the exhaust port 28 are connected to the check valve 64 and the air tank 62 in parallel with respect to the fourth port 52. Consequently, similar to the case where the throttle valve 32 is arranged, it is possible to limit the amount of air discharged to the outside, and further save energy. Further, the throttle valve 58 is the variable throttle valve. Consequently, the throttle valve 58 can easily adjust, regarding the air discharged from the fourth port 52, the ratio of the amount of air supplied to the air tank 62 to the amount of air discharged to the outside via the exhaust port 28.

The fluid pressure cylinder driving device 20A according to the first modification employs the same configuration as that of the fluid pressure cylinder driving device 20 in FIG. 4 except that the throttle valve 58, the silencer 60, the air tank 62, and the check valve 64 are connected to the fourth port 52. Consequently, the fluid pressure cylinder driving device 20A can naturally easily obtain the same effect as that of the above fluid pressure cylinder driving device 20.

4.2 Second Modification

Figure 6:
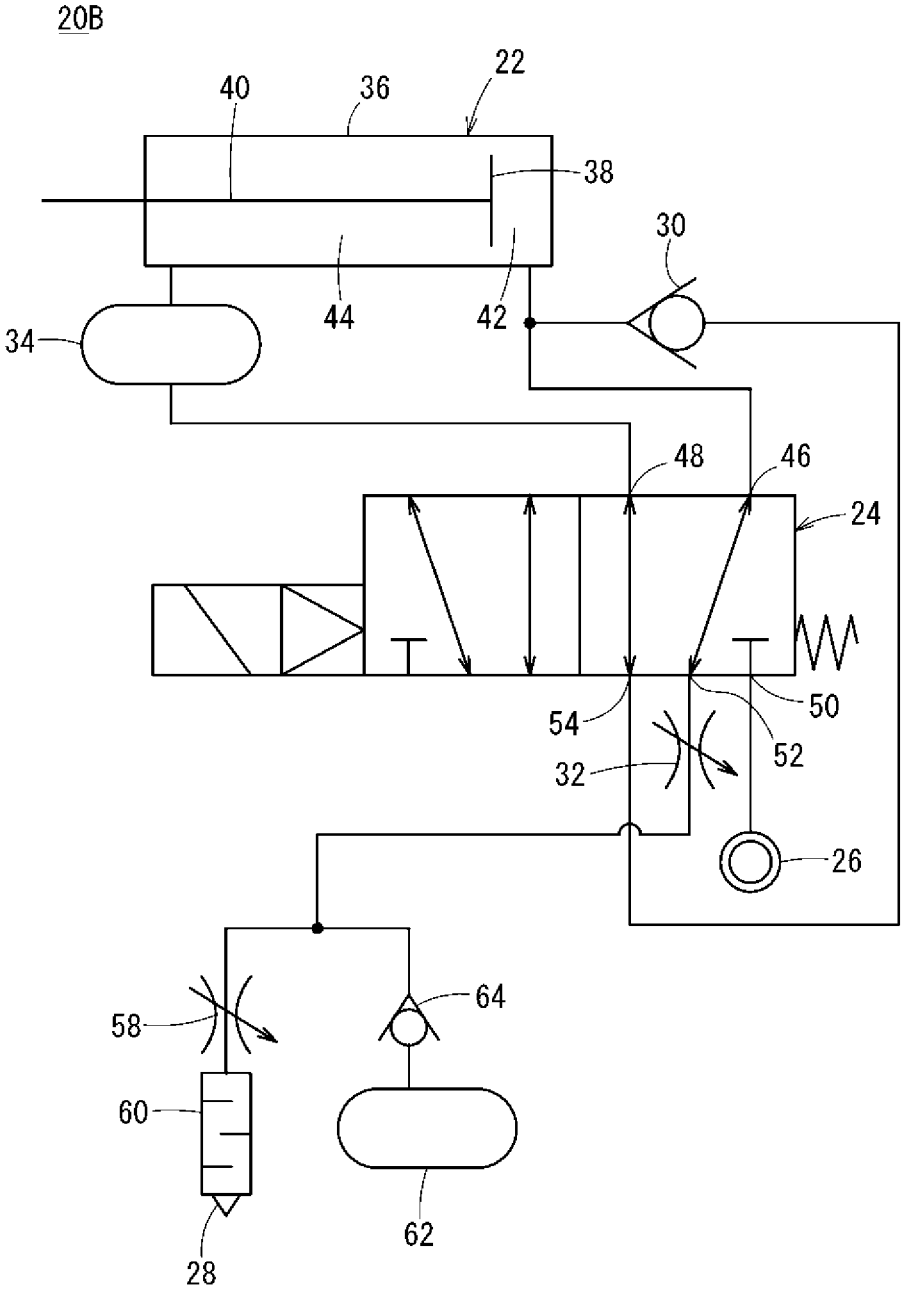
FIG. 6 is a circuit diagram of the fluid pressure cylinder driving device according to a second modification.

The fluid pressure cylinder driving device 20B according to the second modification differs from the fluid pressure cylinder driving device 20A according to the first modification (see FIG. 5) in that, as shown in FIG. 6, the fluid pressure cylinder driving device 20B includes the air tank 34 instead of the tube 56. Hence, it should be noted that there is no great difference between the volume of the tubes extending from the check valve 30 to the rod side cylinder chamber 44 via the switch valve 24 and the volume of other tubes in the fluid pressure cylinder driving device 20B.

In the fluid pressure cylinder driving device 20B, too, the throttle valve 58, the silencer 60, the air tank 62, and the check valve 64 are connected to the fourth port 52. Consequently, the fluid pressure cylinder driving device 20B can obtain the same effect as that of the fluid pressure cylinder driving device 20A according to the first modification. The fluid pressure cylinder driving device 20B includes the air tank 34 and consequently can obtain the same effect as that of the fluid pressure cylinder driving device 20 in FIGS. 1 and 2.

4.3 Third Modification

Figure 7:
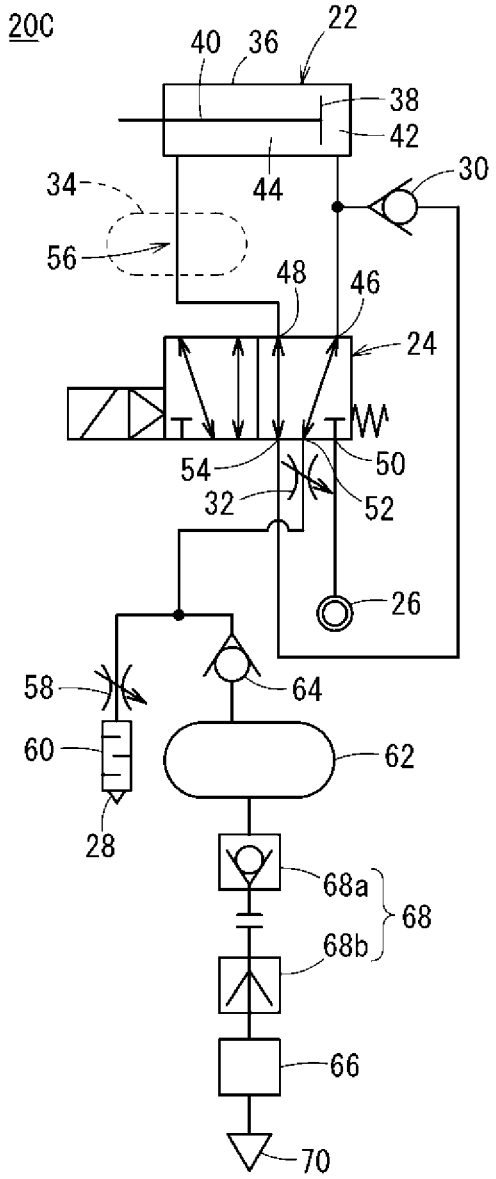
FIG. 7 is a circuit diagram of the fluid pressure cylinder driving device according to a third modification.

The fluid pressure cylinder driving device 20C according to the third modification differs from the fluid pressure cylinder driving devices 20A, 20B according to the first and second modifications (see FIGS. 5 and 6) in that, as shown in FIG. 7), an air blow mechanism (injection mechanism) 66 is connected to the air tank 62 via a coupler 68. The coupler 68 includes a socket portion 68*a* that includes a check valve, and a plug portion 68*b*. The socket portion 68*a* and the plug portion 68*b* are coupled to connect the air tank 62 and the air blow mechanism 66.

Thus, air accumulated in the air tank 62 is supplied to the air blow mechanism 66 via the coupler 68. The air blow mechanism 66 injects air from an injection port 70 toward an external object that is not shown, and can blow air toward the object.

The fluid pressure cylinder driving device 20C may include the tube 56 as indicated by a solid line or may include the air tank 34 instead of the tube 56 as indicated by a broken line. In both cases, it is possible to use air accumulated in the air tank 62 for air below, and obtain the same effect as that of the fluid pressure cylinder driving devices 20A, 20B according to the first and second modifications.

4.4 Fourth Modification

Figure 8:
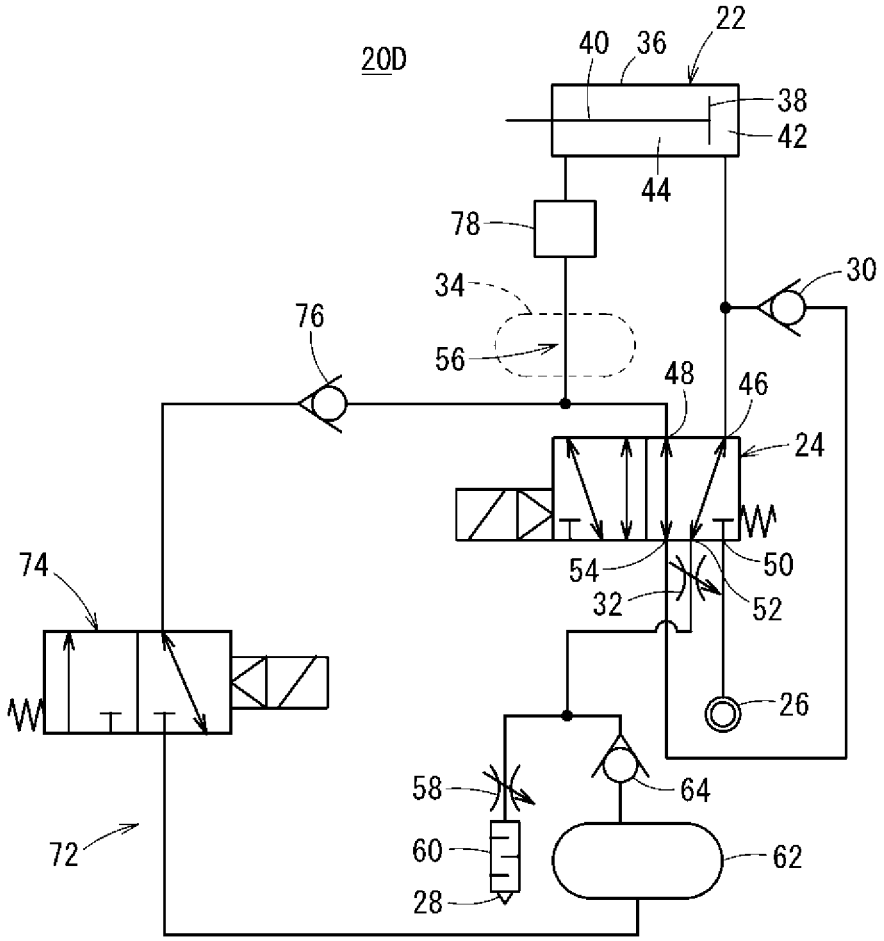
FIG. 8 is a circuit diagram of the fluid pressure cylinder driving device according to a fourth modification.

The fluid pressure cylinder driving device 20D according to the fourth modification differs from the fluid pressure cylinder driving devices 20A to 20C according to the first to third modifications (see FIGS. 5 to 7) in that, as shown in FIG. 8, a first fluid supply mechanism 72 is disposed. The first fluid supply mechanism 72 supplies the air accumulated in the air tank 62 to the rod side cylinder chamber 44 when the switch valve 24 is at the second position and when part of air accumulated in the head side cylinder chamber 42 is supplied from the head side cylinder chamber 42 to the rod side cylinder chamber 44 via the check valve 30 and the switch valve 24.

The first fluid supply mechanism 72 includes a switch valve 74, a check valve 76, and a pressure switch 78 disposed on a path that connects the air tank 62 and the rod side cylinder chamber 44. In this case, the switch valve 74 and the check valve 76 are disposed in this order from the air tank 62 toward the second port 48 on the path that connects the air tank 62 and the second port 48. The pressure switch 78 is disposed on a path that connects the second port 48 and the rod side cylinder chamber 44 at a point closer to the rod side cylinder chamber 44 (between the air tank 34 and the rod side cylinder chamber 44).

While the electric power is provided, the switch valve 74 is at the first position in FIG. 8 and blocks a connection between the air tank 62 and the check valve 76. While the electric power is not supplied, the switch valve 74 is held at the second position by a spring biasing force and connects the air tank 62 and the check valve 76. When the switch valve 74 is at the second position, the check valve 76 allows an air flow from the air tank 62 toward the rod side cylinder chamber 44, and blocks the air flow from the rod side cylinder chamber 44 toward the air tank 62.

When the switch valve 24 is at the second position, the pressure switch 78 detects whether or not a fluid pressure (operating pressure) of the air flowing in the tube (e.g., tube 56) that connects the second port 48 and the rod side cylinder chamber 44 has lowered to a predetermined first threshold. In the case where the operating pressure has lowered to the first threshold, the pressure switch 78 outputs an output signal indicating a detection result to the PLC. The PLC outputs the power provision command to the switch valve 74 and holds the switch valve 74 at the first position when not receiving the output signal from the pressure switch 78. The PLC outputs the power provision stop command to the switch valve 74 and switches the switch valve 74 to the second position when receiving the output signal from the pressure switch 78.

Hence, according to the fluid pressure cylinder driving device 20D, when the switch valve 24 is at the second position, and in a case where an air pressure of air supplied from the head side cylinder chamber 42 to the rod side cylinder chamber 44 has lowered to the first threshold, the pressure switch 78 outputs an output signal to the PLC, and the PLC outputs the power provision stop command to the switch valve 74 and switches the switch valve 74 to the second position. In this way, air accumulated in the air tank 62 is supplied from the air tank 62 to the rod side cylinder chamber 44 via the switch valve 74 and the check valve 76.

As a result, even when the air pressure of the air supplied from the head side cylinder chamber 42 to the rod side cylinder chamber 44 lowers while the piston rod 40 retracts, air of the air tank 62 is supplementarily supplied via the first fluid supply mechanism 72. Consequently, it is possible to keep a moving speed of the piston 38 constant during the retraction, and reliably and efficiently return the air cylinder 22. In this regard, the fluid pressure cylinder driving device 20D employs the same configuration as the fluid pressure cylinder driving devices 20A, 20B of the first and second modifications except that the fluid pressure cylinder driving device 20D includes the first fluid supply mechanism 72. Consequently, the fluid pressure cylinder driving device 20D can naturally obtain the same effect as the fluid pressure cylinder driving devices 20A, 20B.

4.5 Fifth Modification

Figure 9:
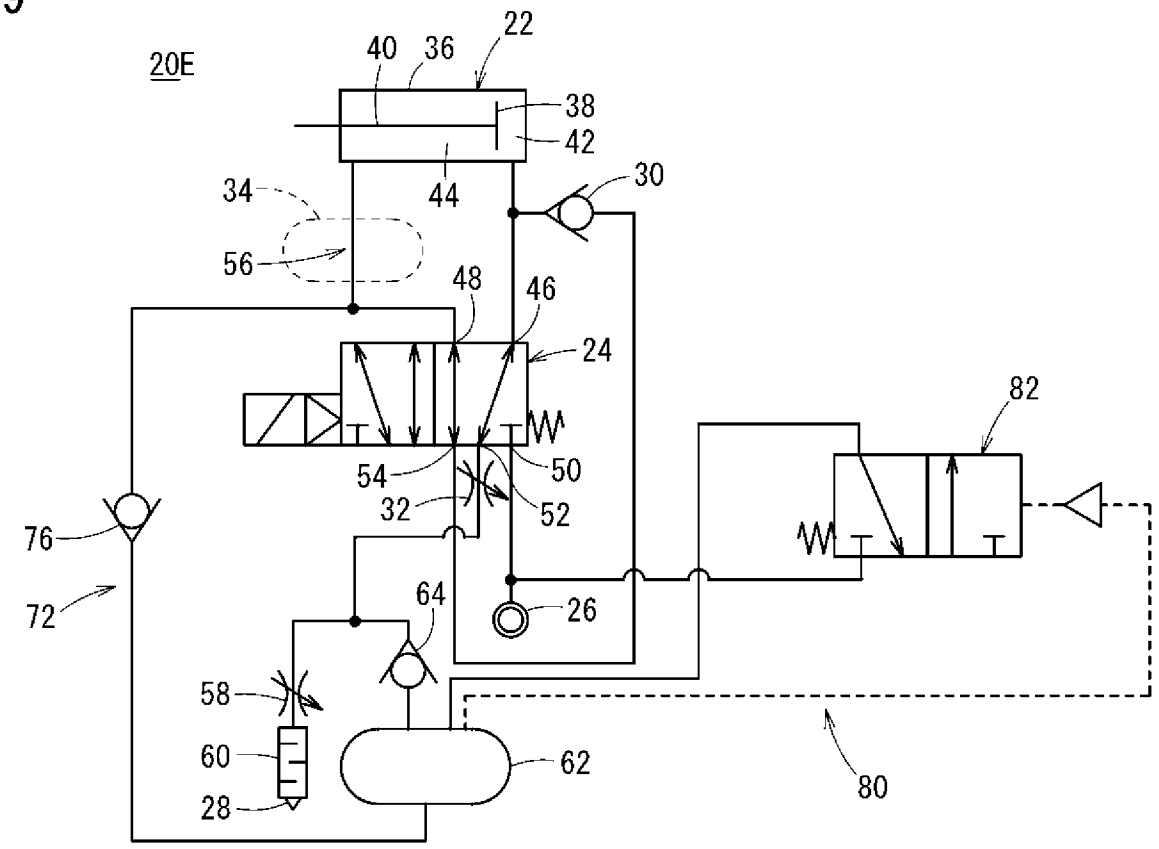
FIG. 9 is a circuit diagram of the fluid pressure cylinder driving device according to a fifth modification.

The fluid pressure cylinder driving device 20E according to the fifth modification differs from the fluid pressure cylinder driving device 20D according to the fourth modification (see FIG. 8) in that, as shown in FIG. 9, the first fluid supply mechanism 72 includes only the check valve 76, and the fluid pressure cylinder driving device 20E further includes a second fluid supply mechanism 80 that supplies air from the high pressure air supply source 26 to the air tank 62.

The second fluid supply mechanism 80 includes an air-operated valve 82 that is disposed on the tube that connects the high pressure air supply source 26 and the air tank 62. When an air pressure in the air tank 62, which is a pilot pressure, is higher than a predetermined second threshold, the air-operated valve 82 maintains the second position shown in FIG. 9, and blocks a connection between the high pressure air supply source 26 and the air tank 62. Meanwhile, in a case where the air pressure in the air tank 62 has lowered to the second threshold, the air-operated valve 82 is switched to the first position and connects the high pressure air supply source 26 and the air tank 62. Thus, the high pressure air supply source 26 supplies a high pressure air to the air tank 62.

According to the fluid pressure cylinder driving device 20E, when the switch valve 24 is at the second position and in a case where the air pressure of the air supplied from the head side cylinder chamber 42 to the rod side cylinder chamber 44 has become lower than the air pressure in the air tank 62, the air accumulated in the air tank 62 is supplied from the air tank 62 to the rod side cylinder chamber 44 via the check valve 76. In a case where the air supply to the rod side cylinder chamber 44 has lowered the air pressure in the air tank 62 to the second threshold, the air-operated valve 82 is switched from the second position to the first position, and the high pressure air supply source 26 supplies the high pressure air to the air tank 62. As a result, it is possible to prevent the air pressure in the air tank 62 from lowering, and supply the high pressure air to the rod side cylinder chamber 44.

As described above, according to the fluid pressure cylinder driving device 20E according to the fifth modification, the first fluid supply mechanism 72 includes only the check valve 76. Consequently, the switch valve 74 and the pressure switch 78 are unnecessary, so that it is possible to simplify the structure of the fluid pressure cylinder driving device 20E. The fluid pressure cylinder driving device 20E further includes the second fluid supply mechanism 80 that supplies the high pressure air from the high pressure air supply source 26 to the air tank 62. Consequently, when air accumulated in the air tank 62 is used, it is possible to prevent the air pressure from lowering. In this regard, the fluid pressure cylinder driving device 20E employs the same configuration as those of the fluid pressure cylinder driving devices 20A, 20B, 20D according to the first, second, and fourth modifications except that the fluid pressure cylinder driving device 20E includes the second fluid supply mechanism 80. Thus, the fluid pressure cylinder driving device 20E can naturally obtain the same effect as the fluid pressure cylinder driving devices 20A, 20B, 20D.

4.6 Sixth Modification

Figure 10:
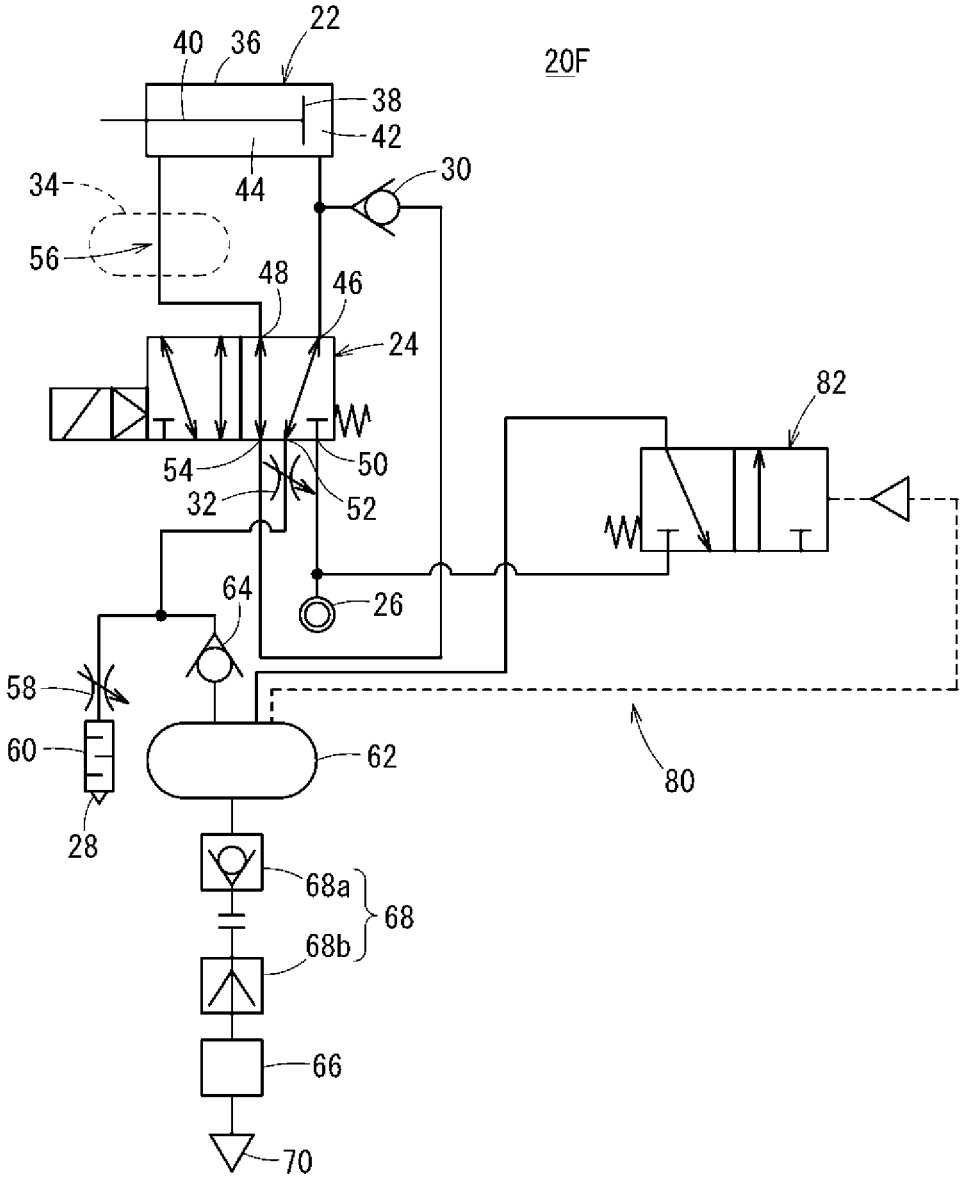
FIG. 10 is a circuit diagram of the fluid pressure cylinder driving device according to a sixth modification.
Figure 11:
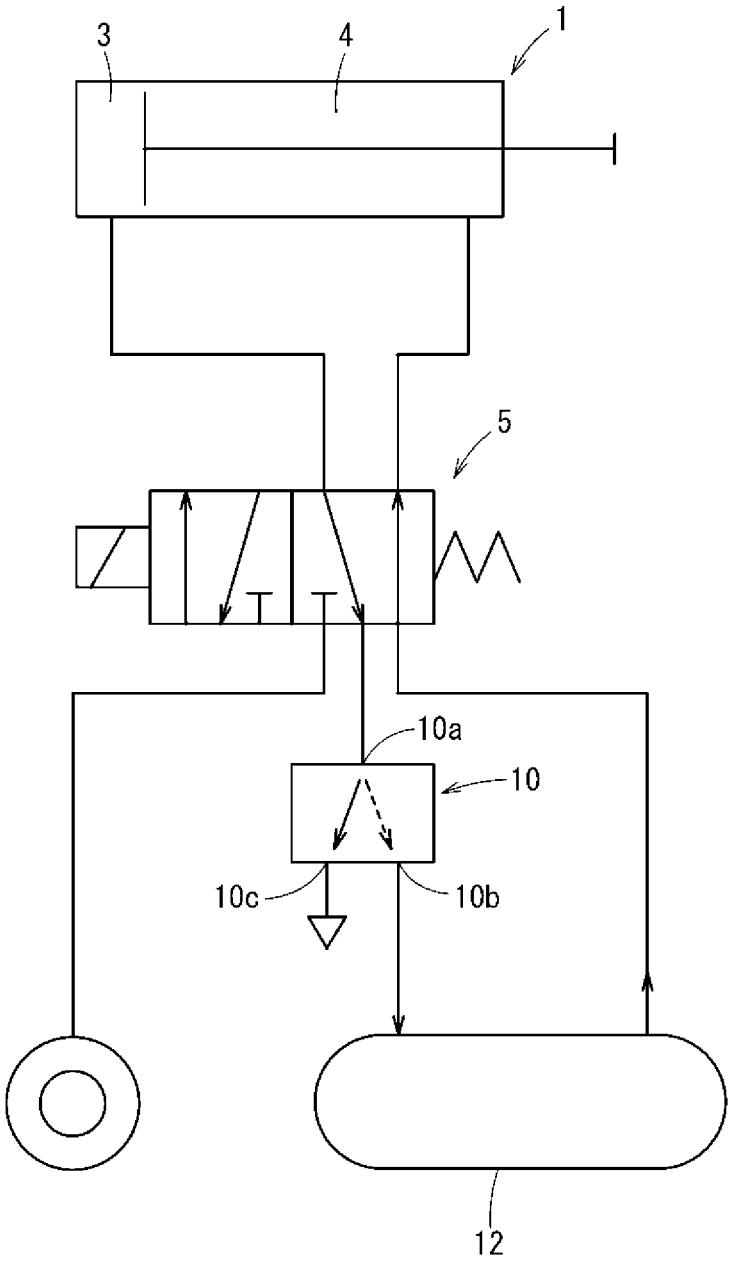
FIG. 11 is a circuit diagram of an actuator driving device according to related art.

The fluid pressure cylinder driving device 20F according to the sixth modification differs from the fluid pressure cylinder driving device 20E according to the fifth modification (see FIG. 9) in that, as shown in FIG. 10, air accumulated in the air tank 62 is used for the air blowing of the air blow mechanism 66. In this case, the fluid pressure cylinder driving device 20F includes the air blow mechanism 66 and the second fluid supply mechanism 80. Thus, the fluid pressure cylinder driving device 20F can obtain the same effect as that of the fluid pressure cylinder driving devices 20C, 20E according to the third and fifth modifications (see FIGS. 7 and 9). The fluid pressure cylinder driving device 20F employs the same configuration as the fluid pressure cylinder driving devices 20A, 20B according to the first and second modifications (see FIGS. 5 and 6). Consequently, the fluid pressure cylinder driving device 20F can naturally obtain the same effect as the fluid pressure cylinder driving devices 20A, 20B.

The driving device of the fluid pressure cylinder according to the present invention is not limited to the above embodiment, and can naturally employ various configurations without departing from the scope of the present invention.

The invention claimed is:

1. A method for driving a fluid pressure cylinder having a head chamber and a rod chamber, comprising:

a driving step of supplying fluid from a fluid supply source to the head chamber via a switch valve, and discharging fluid from the rod chamber to at least an outside;

a supply check valve is provided in a flow passage which branches off from a flow passage connecting the head chamber and the switch valve; and a return step of supplying part of fluid accumulated in the head chamber to the rod chamber via the supply check valve and the switch valve, and discharging a remaining part of the fluid accumulated in the head chamber to at least the outside via the switch valve.

2. A driving device of a double acting fluid pressure cylinder having a head chamber and a rod chamber, comprising:

a switch valve;

a fluid supply source;

a discharge port; and a supply check valve, wherein:

when the switch valve is at a first position, the head chamber communicates with the fluid supply source via the switch valve, and the rod chamber communicates with at least the discharge port;

the supply check valve is provided in a fluid passage which branches off from a flow passage connecting the head chamber and the switch valve; and when the switch valve is at a second position, the head chamber communicates with the rod chamber via the supply check valve and the switch valve, and the head chamber communicates with at least the discharge port via the switch valve.

3. The driving device of the fluid pressure cylinder according to claim 2, wherein a first throttle valve is arranged between the switch valve and the discharge port.

4. The driving device of the fluid pressure cylinder according to claim 3, wherein the first throttle valve is a variable throttle valve.

5. The driving device of the fluid pressure cylinder according to claim 2, wherein a volume of a tube extending from the supply check valve to the another cylinder chamber across the switch valve is larger than a volume of other tubes of the driving device.

6. A driving device of a double acting fluid pressure cylinder comprising:

a switch valve;

a fluid supply source;

a discharge port; and a supply check valve, wherein:

when the switch valve is at a first position, one cylinder chamber communicates with the fluid supply source via the switch valve, and another cylinder chamber communicates with at least the discharge port;

the supply check valve is provided in a fluid passage which branches off from a flow passage connecting the one cylinder chamber and the switch valve; and when the switch valve is at a second position, the one cylinder chamber communicates with the another cylinder chamber via the supply check valve and the switch valve, and the one cylinder chamber communicates with at least the discharge port via the switch valve, wherein a first tank is arranged between the another cylinder chamber and the switch valve.

7. The driving device of the fluid pressure cylinder according to claim 6, wherein a volume of the first tank is substantially half a maximum value of a fluctuating volume of the one cylinder chamber.

8. A driving device of a double acting fluid pressure cylinder comprising:

a switch valve;

a fluid supply source;

a discharge port; and a supply check valve, wherein:

when the switch valve is at a first position, one cylinder chamber communicates with the fluid supply source via the switch valve, and another cylinder chamber communicates with at least the discharge port;

the supply check valve is provided in a fluid passage which branches off from a flow passage connecting the one cylinder chamber and the switch valve; and when the switch valve is at a second position, the one cylinder chamber communicates with the another cylinder chamber via the supply check valve and the switch valve, and the one cylinder chamber communicates with at least the discharge port via the switch valve, further comprising a second tank connected to the discharge port in parallel with respect to the switch valve, wherein:

when the switch valve is at the first position, the another cylinder chamber communicates with the discharge port and the second tank via the switch valve; and when the switch valve is at the second position, the one cylinder chamber communicates with the another cylinder chamber via the supply check valve and the switch valve, and communicates with the discharge port and the second tank via the switch valve.

9. The driving device of the fluid pressure cylinder according to claim 8, wherein a pressure accumulator check valve is arranged between the switch valve and the second tank.

10. The driving device of the fluid pressure cylinder according to claim 8, wherein:

a second throttle valve is arranged between the switch valve and the discharge port; and the second throttle valve and the discharge port are connected to the second tank in parallel with respect to the switch valve.

11. The driving device of the fluid pressure cylinder according to claim 10, wherein the second throttle valve is a variable throttle valve.

12. The driving device of the fluid pressure cylinder according to claim 8, wherein an injection mechanism configured to inject fluid is connected to the second tank via a coupler.

13. The driving device of the fluid pressure cylinder according to claim 12, further comprising a second fluid supply mechanism configured to supply fluid from the fluid supply source to the second tank.

14. The driving device of the fluid pressure cylinder according to claim 8, further comprising a first fluid supply mechanism configured to supply fluid accumulated in the second tank to the other cylinder chamber when the switch valve is at the second position and when part of the fluid accumulated in the one cylinder chamber is supplied from the one cylinder chamber to the other cylinder chamber via the supply check valve and the switch valve.

* * * * *